US010131475B2

(12) United States Patent
Babineau

(10) Patent No.: US 10,131,475 B2
(45) Date of Patent: Nov. 20, 2018

(54) CHILD-PROOF AND TAMPER-EVIDENT MEDICATION PACKAGING

(71) Applicant: Thomas Babineau, Blaine, MN (US)

(72) Inventor: Thomas Babineau, Blaine, MN (US)

( * ) Notice: Subject to any disclaimer, the term of this patent is extended or adjusted under 35 U.S.C. 154(b) by 72 days.

(21) Appl. No.: 15/186,686

(22) Filed: Jun. 20, 2016

(65) Prior Publication Data

US 2016/0368676 A1 Dec. 22, 2016

Related U.S. Application Data

(60) Provisional application No. 62/181,542, filed on Jun. 18, 2015.

(51) Int. Cl.

| | |
|---|---|
| ***B65D 83/04*** | (2006.01) |
| ***B65D 85/42*** | (2006.01) |
| ***B65D 50/04*** | (2006.01) |
| ***B65D 1/40*** | (2006.01) |
| ***B65D 25/28*** | (2006.01) |
| ***B65D 25/04*** | (2006.01) |
| ***A61J 1/00*** | (2006.01) |

(52) U.S. Cl.

CPC ..... *B65D 50/043* (2013.01); *A61J 1/00* (2013.01); *B65D 1/40* (2013.01); *B65D 25/04* (2013.01); *B65D 25/28* (2013.01); *B65D 2101/00* (2013.01)

(58) Field of Classification Search

CPC ..... B65D 50/043; B65D 1/40; B65D 25/04; B65D 25/28; B65D 2101/00; B28B 7/0029; B28B 7/087; A23G 3/0053; A23G 3/0273; A23G 3/563; A23G 3/56; A23G 3/02; A23G 3/12; A23G 3/125; A23G 3/0268; A61J 1/00

USPC ..... 206/530, 539, 828, 807; 220/4.23, 4.22, 220/4.21; 53/453, 173; 249/81, 249/137–139, 154, 204, 117, 119; 426/515, 512, 101, 389; 264/259

See application file for complete search history.

(56) References Cited

U.S. PATENT DOCUMENTS

| | | | | |
|---|---|---|---|---|
| 1,906,882 A * | 5/1933 | Perret | A23G 1/21 | 249/137 |
| 2,166,568 A * | 7/1939 | Kuhlke | A23G 3/0236 | 156/213 |
| 4,100,249 A * | 7/1978 | Giron | B28B 7/303 | 249/139 |
| 5,186,661 A * | 2/1993 | Capper | B65D 43/164 | 439/521 |

(Continued)

*Primary Examiner* — Rafael Ortiz

(74) *Attorney, Agent, or Firm* — Underwood & Associates, LLC

(57) ABSTRACT

A child-proof and tamper-evident medication dispenser mold assembly includes first and second mold halves configured to be reversibly mated to form a product mold having an interior chamber for receiving an edible compound and a channel extending from the interior chamber to an outside surface of the assembly. The assembly further includes a male hinge component disposed on the first mold half and a female hinge component disposed on the second mold half, wherein each of the male and female hinge components are operable to cooperatively form a hinge assembly for mating the first and said second mold halves in an operable configuration. The male hinge component includes an aperture. The aperture, channel and interior chamber are substantially coaxially aligned.

19 Claims, 3 Drawing Sheets

(56) References Cited

U.S. PATENT DOCUMENTS

| | | | | |
|---|---|---|---|---|
| 5,788,873 | A * | 8/1998 | Warsaw | A23G 3/0263<br>249/170 |
| 6,162,476 | A * | 12/2000 | Shorin | A23G 3/563<br>220/4.23 |
| 6,932,994 | B1 * | 8/2005 | Gladin | A23G 9/14<br>426/101 |
| 7,841,848 | B2 * | 11/2010 | Tatham | A22C 7/0046<br>425/188 |
| 9,402,783 | B2 * | 8/2016 | Laibe | A61J 1/03 |
| 2006/0034989 | A1 * | 2/2006 | Hermansen | A23G 9/083<br>426/515 |
| 2007/0096365 | A1 * | 5/2007 | Jones | A23G 3/0055<br>264/259 |
| 2010/0276567 | A1 * | 11/2010 | MacAlister | F25C 1/22<br>249/134 |
| 2015/0150300 | A1 * | 6/2015 | Raineri | A23P 1/105<br>249/96 |

* cited by examiner

CHILD-PROOF AND TAMPER-EVIDENT MEDICATION PACKAGING

CROSS REFERENCE TO RELATED APPLICATIONS

This application claims priority to and the benefit of U.S. Provisional Patent Application No. 62/181,542, filed on Jun. 18, 2015, the contents of which are incorporated by reference in their entirety as if fully set forth herein.

TECHNICAL FIELD

This disclosure relates to medication packaging that is both child-proof and tamper-evident. In particular, this disclosure relates to systems and methods for forming a child-proof and tamper-evident packaging for medicated lollipops and the like.

BACKGROUND

Careful parents ensure that medications are stored out of reach of children, for example, high in a cabinet or locked in a suitable location to prevent access. Each year, however, children gain unauthorized access to medications, sometimes resulting in tragedy. Medications are sold in many forms, such as tablets, pills, liquids, gels, and powders. Existing child-proof mechanisms include specially-designed twist-off bottle caps for liquid medications and pill bottle tops requiring a combination of squeezing and turning to remove the cap, among others.

Federal anti-tamper laws were imposed after an incident in 1982 where potassium cyanide-laced analgesics led to the death of seven people in Chicago. Since then, medication packages typically include some method for alerting the consumer if the package has been tampered. Examples of tamper-evident packaging includes so-called 'blister packs,' induction seals, and cap-rings which can indicate to the consumer that the package may have been compromised or contaminated.

SUMMARY

In one exemplary aspect, a packaging for medicated lollipops incorporating at least one child-proof opening mechanism and tamper evidency is provided. In one embodiment, the packaging includes two mold halves that are configured to be reversibly mated together to form a mold for forming a solid medication delivery matrix, which, in a preferred embodiment is candy in the form of a lollipop. In this embodiment, the mold includes a top aperture and a bottom aperture. The bottom aperture is configured for receiving a lollipop stick which, when inserted into the mold, substantially seals the bottom aperture. The top aperture is configured for receiving a solidifiable, liquid medication delivery matrix, which can also include one or more medications as an ingredient.

In this embodiment, a rim extends from around the top aperture which is configured to receive a cap member. In one embodiment, the rim and cap member are cooperatively configured as a child-proof cap which requires more than simply unscrewing or sliding the cap from the rim to remove. For example, to remove the cap from the mold, it may be required to apply a downward pressure while unscrewing the cap from the rim.

In this and other embodiments, the mold can be configured such that when it is in an assembled configuration, the only way to access the medicated lollipop (other than by destroying the packaging which would provide its own tamper evidency) is by first removing the cap from the rim. In one embodiment, the rim can additionally include a tamper-evidency seal across its top; in another embodiment, the mold can include seals or other mechanisms for providing tamper evidency.

In another exemplary aspect, a child-proof and tamper-evident medication dispenser mold assembly is disclosed. In one embodiment, the assembly includes first and second mold halves configured to be reversibly mated to form a product mold having an interior chamber for receiving an edible compound such as a medication delivery matrix, and a channel extending from the interior chamber to an outside surface of the assembly. In this embodiment, a male hinge component is disposed on the first mold half and a female hinge component is disposed on the second mold half. Each of the male and female hinge components are operable to cooperatively form a hinge assembly for hingedly coupling the first and the second mold halves. In one embodiment, the male hinge component includes an aperture; in such an embodiment, the aperture, channel and interior chamber can be substantially coaxially aligned.

In one exemplary aspect, a child-proof and tamper-evident product container is provided.

The container includes a product mold, itself including a first mold portion configured to reversibly engage a second mold portion, wherein the first mold portion includes a first component of a hinge assembly, and a first portion of a securement fitting 125*a*. The second mold portion includes a second component of the hinge assembly and a second portion of the securement fitting 125*b*. The securement fitting is configured for engagement with a securement member when the first mold portion is engaged with the second mold portion.

In one embodiment, the securement fitting and the securement member are cooperatively configured to provide child-proofing of the product container. In a related embodiment, the securement fitting is a collar including at least one threaded portion, and the securement member is a cap including a complimentary threaded portion configured to require concurrent compression and twisting force to disengage the cap from the collar.

In one embodiment, the product mold includes a cavity for receiving a medication, a medication delivery matrix, or a mixture of a medication and a medication delivery matrix. In a related embodiment, the product mold is configured for producing a medicated lollipop product. In a further related embodiment, the cavity includes cavity walls configured to transfer a design, indicia or marking to the medicated lollipop product.

In one embodiment, the first component of the hinge assembly is an L-shaped member having an aperture therein; and the second component of the hinge assembly is a T-shaped member having a protrusion configured to be received by the aperture in the L-shaped member.

In one embodiment, at least one of the first component or the second component of the hinge assembly includes a locking aperture configured to receive a handle member. In a related embodiment, the handle member prevents disengagement of the first and the second hinge assembly components when advanced through the locking aperture. In a related embodiment, the container further includes a channel spanning the locking aperture and the chamber configured to receive the handle member.

In one embodiment, the container further includes a partition member adjacently disposed to the securement fitting that is configured to provide tamper-evidency. In a related embodiment, the partition member includes an aperture for placing a tamper-evidency seal thereover.

In one embodiment, the first mold portion includes at least one locking arm and the second mold portion includes a number of locking arm apertures equal to the number of locking arms, wherein at least one locking arm and the locking arm apertures are configured to cooperatively engage the first mold portion with the second mold portion.

In one exemplary aspect a method for making a child-proof and tamper-evident product container is provided. The method includes providing a first product mold portion, the first product mold portion including a first cavity portion of a medicated product mold, a first hinge portion of a locking hinge, and a first collar portion of a child-proof capping assembly. The method further includes providing a second product mold portion, the second product mold portion including a second cavity portion of the medicated product mold, a second hinge portion of the locking hinge, and a second collar portion of the child-proof capping assembly.

In one embodiment, the method further includes bringing the first product mold portion and the second product mold portion into a confronting relationship and placing a medication within the medicated product mold.

In one embodiment, the method further includes providing a cap configured to reversibly engage the collar of the child-proof capping assembly and engaging the cap with the collar.

In one embodiment, the locking hinge includes an aperture for receiving a handle member. In a related embodiment, the method further includes advancing the handle member through the aperture of the locking hinge and into the medicated product mold.

In one embodiment, the first cavity portion is juxtaposed between the first hinge portion and the first collar portion.

In yet another exemplary aspect, a child-proof and tamper-evident medicated product container is disclosed. The container includes first and second product mold portions configured to be reversibly mated together to form a product mold for receiving a medicated compound. The container further includes child-proofing measures configured to thwart access to the medicated compound by children and tamper-evidency measures providing visual or tactile indication that the purity of the medicated compound has or has not been compromised.

Certain advantages of the systems and methods include the ability to provide children medication in a form that they associate with candy while, at the same time, protecting children from unauthorized access to medication through the use of child-proof packaging. Furthermore, tamper-evidency is provided in various ways so that a person administering the medication can be confident that the product has not been tampered with.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

As used herein the term 'child-proof' is not an absolute term, but one that is meant to define packaging that is significantly difficulty for a small child, e.g., of the age of about 0-7 years old, to open and thereby access the contents of the package. Similarly, the term 'tamper-proof' is non-absolute, instead referring to packaging that readily informs a person, e.g., by visual or tactile cues, if certain security or tamper-evidency packaging elements have been breached or meddled with.

Figure 3:
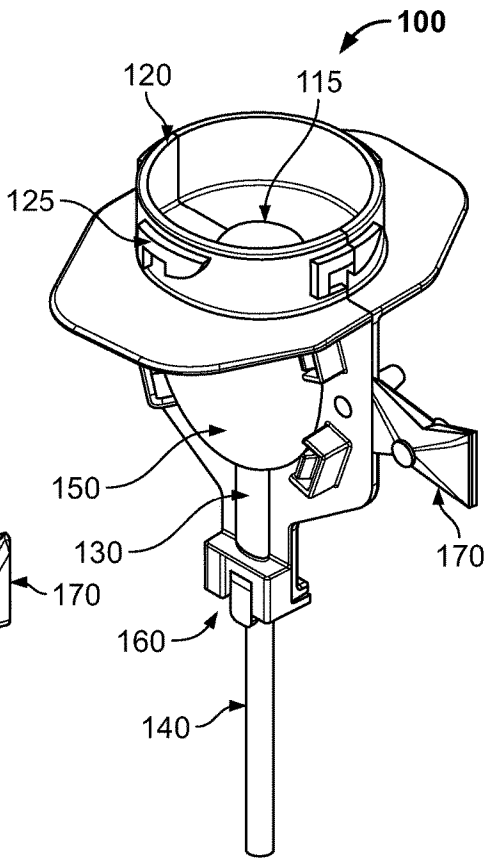
FIGS. 1-3 illustrate various perspective views of a child-proof and tamper-evident medication container according to one embodiment.
Figure 2:
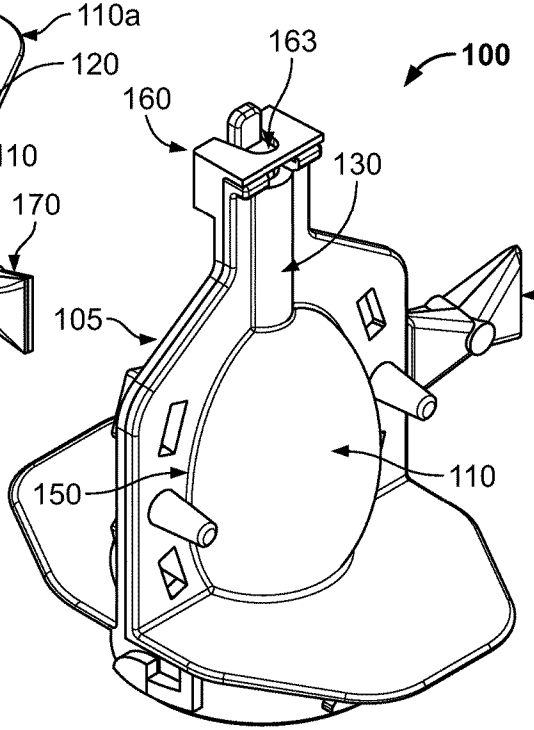
Figure 1:
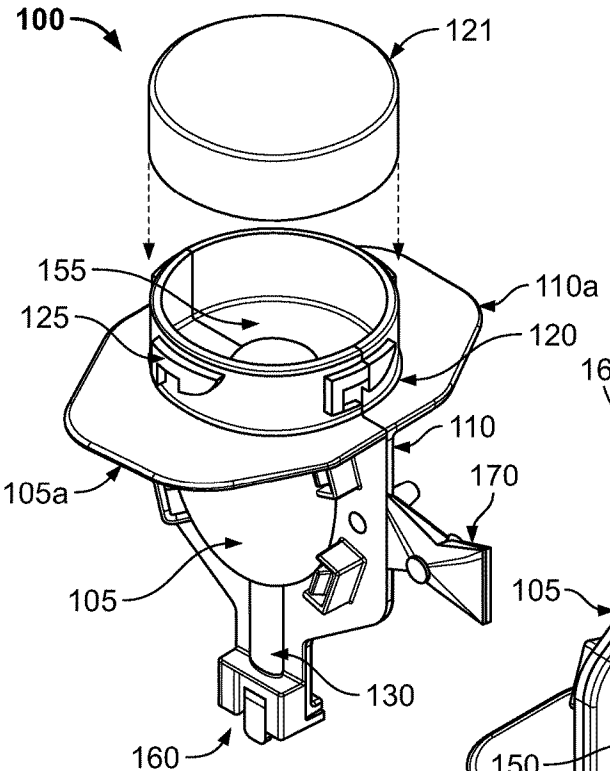

Referring now to FIGS. 1-3, perspective views of a child-proof and tamper-evident medication container (hereinafter "container") 100 are shown in an assembled configuration according to one embodiment. In this embodiment, the container 100 is a mold formed from first and second product mold halves 105, 110, respectively. The first and second mold halves 105, 110 are configured such that they can be reversibly mated in an operable configuration to form a mold for making medicated lollipops. The medicated lollipops can serve as a delivery matrix for delivering a medication to a subject. It should be understood that the container 100 can be formed in various sizes and shapes to appeal to children, for marketing, advertising or other considerations and is not limited solely to the embodiments illustrated in the figures.

In this embodiment, an interior reservoir is formed when the first and second mold halves 105, 110 are mated together, where the shape and volume of the interior reservoir is defined in part by the inner surface of exterior wall 150. An upper portion of the reservoir is defined in part by partition 155, the center of which includes aperture 115 which can be used for filling the reservoir with a medicating compound or delivery matrix in liquid form during manufacture of a medicated lollipop as described in greater detail below. Bottom aperture 163 is configured to receive a handle member 140 which, in this embodiment, forms the "stick" of the medicated lollipop. When placed as illustrated in FIG. 3, handle member 140 fits into bottom aperture 163, thereby forming a plug that substantially prevents leakage of the medicating compound through bottom aperture 163 when forming a medicated lollipop from a solidifiable liquid or semi-liquid compound or mixture.

In this embodiment, container 100 includes a securement fitting and a securement member that cooperatively secures first (105) and second (110) mold halves together in a childproof configuration. In this embodiment, the securement fitting is a circumferential collar 120 extending generally perpendicularly from the perimeter of partition 155. In this embodiment, collar 120 includes one or more threaded portions, e.g., threaded portion 125 that are collectively configured to engage a correspondingly threaded portion of the securement member. In this embodiment, the securement member is a cap member 121 for cooperatively forming a child-proof cap assembly with collar 120. For example, the threaded portion 125 can be configured so that, to remove the cap from the collar, a simultaneous application of a downward-urging force (toward bottom aperture 163) and twisting of the cap 121 can be required, similar to child-proof caps available for certain prescription medication bottles. It should be understood that other alternative combinations of securement fitting and securement member can be used, for example, snap-lock assemblies, post-and-lever assemblies, and other mechanisms for child-proofing.

In this and other embodiments, the combination of collar 120 and a correspondingly-configured child-proof cap can cooperatively prevent the container 100 from being disassembled into its constituent first and second mold halves 105, 110 when the cap is engaged with the collar 120.

In this embodiment, a bottom portion of the container 100 includes a hinge assembly 160 including male and female interlocking components as described in greater detail below. The hinge assembly 160 is configured such that bottom portions of the first and second mold halves 105, 110 can be brought together in a hinged relationship; the container can then be assembled in an operative configuration for receiving a medicated compound by subsequently bringing each of the first and second mold halves 105, 110 together in a confronting relationship, as shown in FIGS. 1-3. Thus, first (105) and second (110) mold halves can be effectively locked into the container configuration shown, e.g., in FIGS. 1-3 by joining male and female interlocking components of the hinge assembly 160, inserting a stick therethrough as described in greater detail below, aligning the first and second mold halves 105, 110 as shown, and applying the child-proof cap 121 to collar 120. In such a configuration, both the top of the container 100 (e.g., near collar 120) and the bottom of the container (e.g., near hinge assembly 160) can be locked in a child-proof and tamper-evident configuration. An adult, however, can remove the cap using a twisting motion to disengage it from collar 120, thereby unlocking the container 100 and allowing access to a medicated lollipop therein.

Figure 4A:
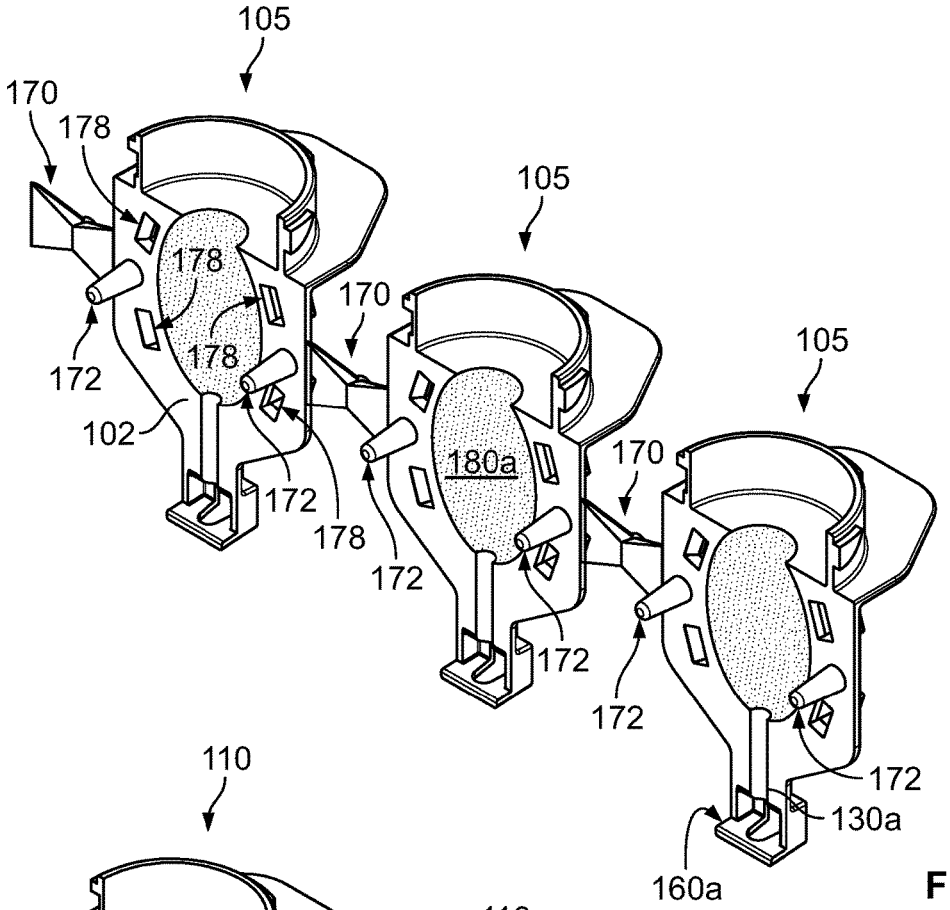
FIG. 4 illustrates a plurality of serially-connected first mold body halves (frame A) and plurality of serially-connected second mold body halves (frame B) capable of cooperatively forming a plurality of child-proof and tamper-evident medication containers according to one embodiment.
Figure 4B:
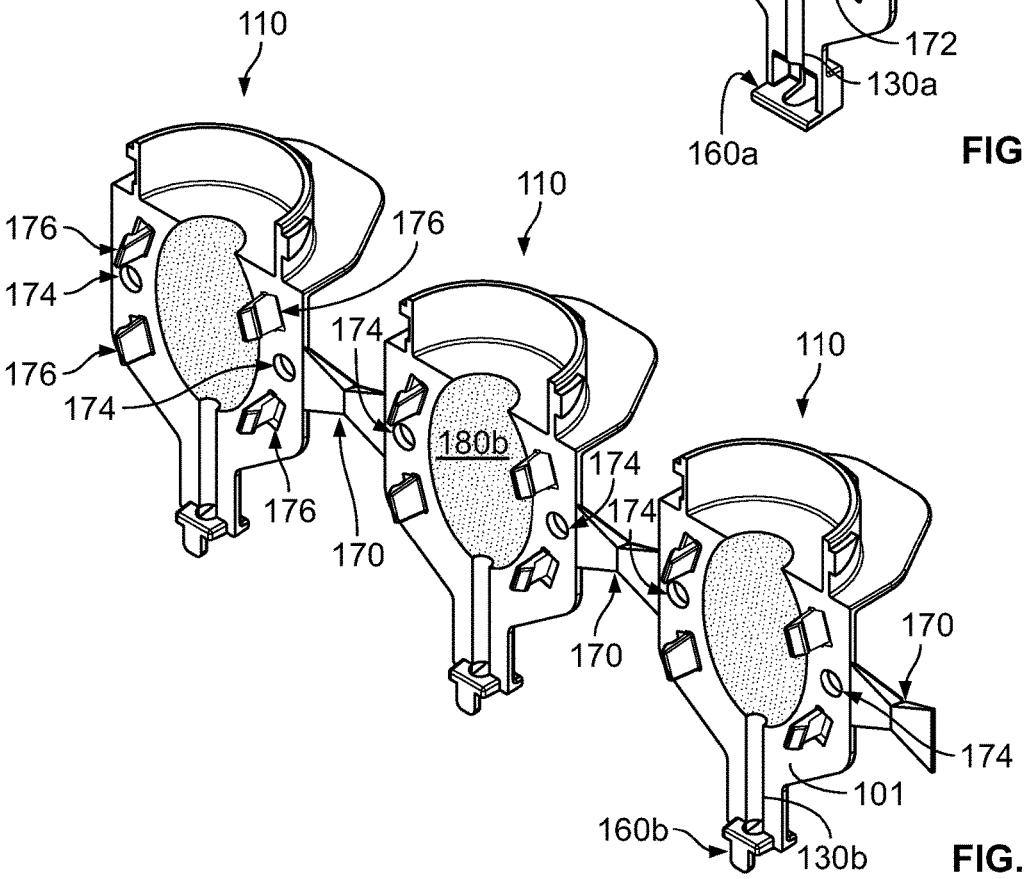

Referring now to FIG. 4, first (105, frame "A") and second (110, frame "B") mold halves are shown serially-coupled to a neighboring mold half to illustrate one approach for forming a plurality of containers 100. In FIG. 4, certain components discussed with respect to FIGS. 1-3 are shown halved and referred to by "a" and "b" suffixes to the identifiers used in FIGS. 1-3. For example, respective halves of channel 130 are referred to as 130*a* and 130*b* on each mold half, respectively. In this embodiment, each mold half component is joined to a neighboring mold half component by arm 170. In one embodiment, the connecting intersection of each arm 170 can include a perforated or thinned section to allow separation between a mold half and its neighbor; it should also be understood that such a perforated section can also allow separation of a container 100 in assembled form (e.g., as shown in FIGS. 1-3). Other approaches providing seperability of containers 100 can be substituted according to preference.

In this embodiment, the first mold half 105 includes a first set of alignment arms 172 that are configured to be inserted into a corresponding set of alignment apertures 174 disposed in the second mold half 110. Similarly, the second mold half 110 includes a plurality of locking arms 176 that are configured to be received and reversibly-lockingly engaged by a correspondingly-disposed plurality of locking arm apertures 178 disposed in the first mold half 105. The alignment arms 172, alignment apertures 174, locking arms 176 and locking arm apertures 178 are configured in such a way as to align the first (105) and second (110) mold halves prior to engagement therebetween for assembling the container 100 in an operative configuration, e.g., as shown in FIGS. 1-3. It should be understood, however, that the alignment mechanisms shown and discussed are one of many possible approaches for proving mold half alignment during assembly of the container 100 and that other approaches may be substituted according to preference.

In this embodiment, the size and shape of a medicated lollipop formed in container 100 can be defined by interior walls 180*a*, 180*b*, which together form the interior cavity of the container 100 when surfaces 101 and 102 are brought to a confronting relationship. In this embodiment, the interior walls 180*a*, 180*b* are shown as smooth, concave surfaces; however, it should be understood that the interior walls can be formed into any desired shape, e.g., disc-shaped, square-shaped, etc. Furthermore, in one embodiment, one or both of the interior walls 180*a*, 180*b* can include molded indicia which will transfer to the exterior surface of a medicated lollipop product when formed. For example, molded indicia can include a name of a medication contained in the lollipop, a medication dosage, manufacturer, trademark, advertising or other indicia that will be present on a medicated lollipop formed within container 100.

Figure 5:
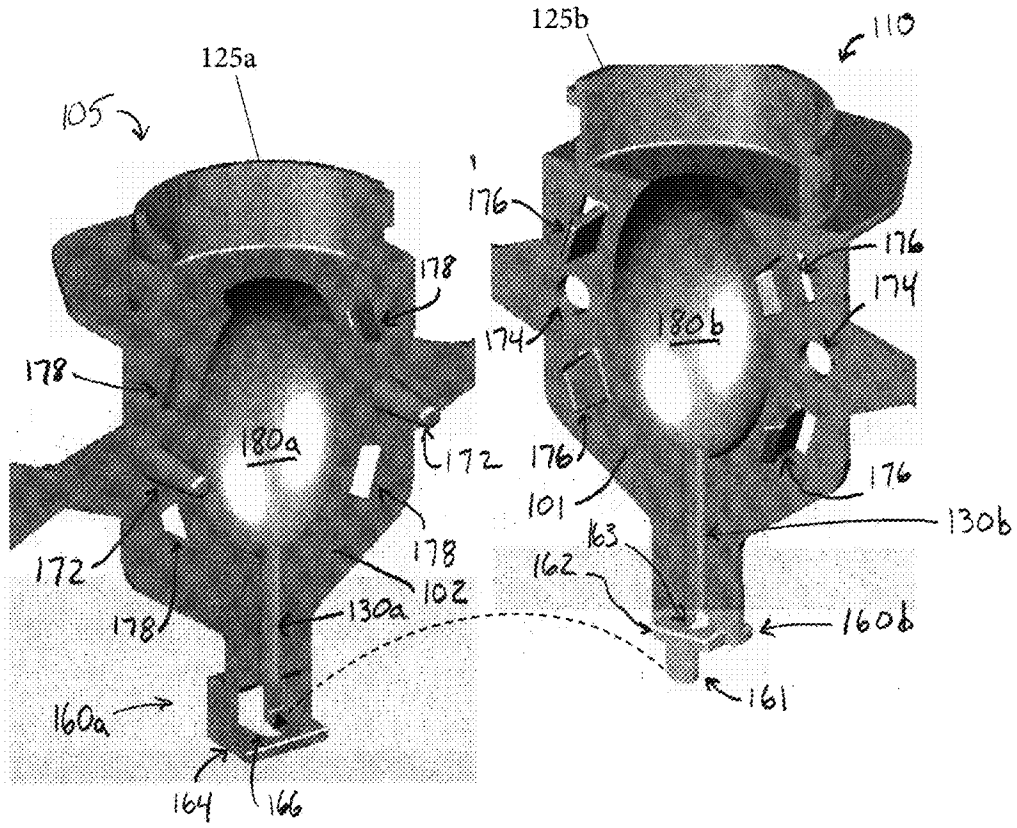
FIG. 5 shows magnified views of first and second halves of a child-proof and tamper-evident medication container according to one embodiment.
Figure 6:
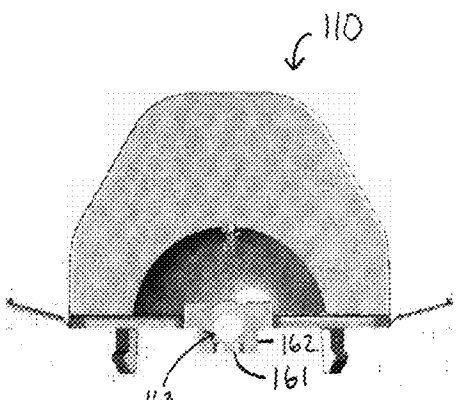
FIG. 6 illustrates a bottom view of a child-proof and tamper-evident medication container mold body half, according to one embodiment.

Referring now to FIG. 5, first (105) and second (110) halves of container 100 are shown in greater detail to highlight portions of hinge assembly 160 which includes an L-shaped female hinge portion 160*a* and a T-shaped male hinge portion 160*b*. In this embodiment, the female hinge portion 160*a* includes an L-shaped arm member 164 which itself includes an aperture 166, and the male hinge portion 160*b* includes a shoulder 162 and a protrusive tongue member 161 extending therefrom. Shoulder 162 additionally includes a substantially centrally-disposed aperture 163 having a shape substantially equal to the cross-section of handle 140, so that handle 140 forms a plug when inserted into aperture 163. In this embodiment, recess 166 is configured to receive tongue member 161 as illustrated by the dashed line therebetween in FIG. 5.

In this embodiment, the first and second mold halves 105, 110 are configured such that when tongue 161 is received into recess 166, and each mold half 105, 110 is oriented to bring surfaces 101 and 102 into a confronting relationship during assembly of the container 100, aperture 163 is coaxially aligned with channel 130. In this configuration, handle 140 can serve as a locking member by advancing handle 140 through aperture 163 and into channel 130 to substantially prevent the female and male hinge portions 160*a*, 160*b* from decoupling. Such a configuration allows advantageous interlocking of the hinge assembly 160 for child-proofing and tamper evidency, while also allowing handle 140, the lollipop 'stick,' to be inserted through aperture 163 and into channel 130 for forming a medicated lollipop product.

In this embodiment, a medicated lollipop can be formed by assembling the container 100 as shown, e.g., in FIGS. 1-3. Next, a lollipop handle 140 can be inserted through aperture 163 of hinge assembly 160 as described, through channel 130, and at least partially into the interior reservoir defined in part by interior walls 180*a*, 180*b*. Next, the reservoir can be filled with, e.g., a solidifiable liquid or semi-liquid delivery matrix, including a medication if desired, through aperture 115. Medications can be any type of medicinal compound, pharmacological agent, drug or similar compound; a delivery matrix can be, e.g., a non-medicinal, ingestible substance, one which preferably has no affinity for chemical interaction with the medicating compound. Non-limiting examples of a delivery matrix include a flavored corn syrup/sugar mixture used in the formation of lollipops and other hard or semi-hard candies.

Next, as an alternative step, a tamper-evident seal can be placed onto partition 155 so as to cover aperture 115. The tamper-evident seal can be placed and configured over aperture 115 such that it will break, tear or otherwise exhibit signs of tampering if the container 100 has been opened or otherwise compromised, e.g., if first and second mold halves 105, 110 have been separated, or any other attempt to access or alter contents within the container 100. Similarly, tamper-evidency seals, tapes or other mechanisms can be placed on other portions of the container 100 to make any attempts to open the container by a person other than the consumer plainly evident.

In this embodiment, when a consumer wishes to access the medicated lollipop, e.g., the parent of a child for whom the medicated lollipop is intended, they can remove cap 121 from collar 120 by defeating the child-proof mechanism present, e.g., by applying concurrent downward and twisting force to the cap. Pull tabs 105*a*, 110*a*, each of which are integral with first (105) and second (110) mold halves respectively, can then be pulled apart in opposite directions. This can expose the edible portion of the lollipop; the lollipop, including stick 140 can then be pulled through the hinge assembly 160 and channel 130 to completely disassociate from the container 100. It should be noted that, in this embodiment, partition 155 prevents the lollipop from being advanced upward, out of container 100 until the first (105) and second (110) mold halves are at least partially separated. In a preferred embodiment, aperture 166 has an elongate shape configured to allow the first (105) and second (110) mold halves to be hingedly separated by a desired amount without the male and female portions of the hinge assembly (160*a*, 160*b*) pinching the handle member.

Thus, in this embodiment, container 100 provides child-proof protection of a medicated lollipop by virtue of the hinge assembly 160 and engagement between a cap and collar 120 assembly, which both cooperate to substantially prevent first (105) and second (110) mold halves from separating without the strength and dexterity owned by an adult to remove the cap from the collar 120. The container 100 additionally provides tamper evidency of the medicated lollipop product by providing partition 155 which provides a surface to effectively cover aperture 115 with a tamper-evidency seal or other mechanism. Further tamper evidency can be provided by applying additional tamper evidency seals on exterior portions of the container, e.g., along or circumferentially perpendicular to the interface of first (105) and second (110) mold half portions.

A number of illustrative embodiments have been described. Nevertheless, it will be understood that various modifications may be made without departing from the spirit and scope of the various embodiments presented herein. For example, while a child-proof cap-and-collar combination has been described for child-proofing the container 100, other alternative mechanisms may be employed to achieve the same or similar benefits. Accordingly, other embodiments are within the scope of the following claims.

What is claimed is:

1. A medicated product container, comprising:

a medicated product mold comprising:

a securement member, a first mold portion and a second mold portion, wherein said first mold portion and said second mold portion are configured to be reversibly mated;

wherein said first mold portion comprises a first component of a hinge assembly, a first portion of a securement fitting, a first interior recess defined by a first substantially concave wall for forming a first portion of said medicated product mold and a first channel half extending from said first recess to said first component of said hinge assembly;

wherein said second mold portion comprises a second component of said hinge assembly, a second portion of said securement fitting, a second interior recess defined by a second substantially concave wall for forming a second portion of said medicated product mold and a second channel half extending from said second recess to said second component of said hinge assembly;

wherein said securement fitting is configured for engagement with said securement member when said first mold portion is mated with said second mold portion; and wherein when said first and said second mold portions are mated, said first and said second channel halves cooperatively form a channel leading from said hinge assembly to said first and said second recesses.

2. The medicated product container of claim 1, wherein said securement fitting and said securement member are configured to cooperatively provide child-proofing of said product container.

3. The medicated product container of claim 2, wherein said securement fitting is a collar comprising at least one threaded portion, and said securement member is a cap comprising a complimentary threaded portion configured to require concurrent compression and twisting force to disengage said cap from said collar.

4. The medicated product container of claim 1, wherein said first and said second recesses cooperatively define a product mold for receiving a medication, a medication delivery matrix, or a mixture of a medication and a medication delivery matrix.

5. The medicated product container of claim 4, wherein said product mold is configured for producing a medicated lollipop product.

6. The medicated product container of claim 5, wherein said product mold comprises a design, indicia or marking transferrable to said medicated lollipop product.

7. The medicated product container of claim 4, wherein said first component of said hinge assembly is an L-shaped member having a first aperture therein;

wherein said second component of said hinge assembly is a T-shaped member comprising:

a shoulder extending perpendicularly to said second channel half, said shoulder comprising a second aperture; and a protrusion extending perpendicularly to said shoulder; and wherein a width of said protrusion is less than a width of said first aperture in said L-shaped member.

8. The medicated product container of claim 4, further comprising:

a handle member;

wherein at least a portion of said handle member has a cross-sectional shape and size complementary to said second aperture in said shoulder.

9. The medicated product container of claim 8, wherein said handle member prevents disengagement of said first and said second hinge assembly components when advanced through said first and said second apertures.

10. The medicated product container of claim 8, wherein said channel has a shape and size that is complimentary to said at least a portion of said handle member.

11. The medicated product container of claim 4, further comprising a tamper-evidency partition member adjacently disposed to said securement fitting.

12. The medicated product container of claim 11, wherein said partition member comprises an aperture for placing a tamper-evidency seal thereover.

13. The medicated product container of claim 1, wherein said second mold portion comprises at least one locking arm and said first mold portion comprises a number of locking arm apertures equal to the number of locking arms of said second mold portion;

wherein said at least one locking arm and said locking arm apertures are configured to cooperatively engage said first mold portion with said second mold portion in a mated configuration.

14. A method for making a medicated lollipop product, comprising:

providing a first medicated product mold portion, said first medicated product mold portion comprising:

a first cavity portion defined by a first recess in a first wall of said first medicated product mold portion;

a first hinge portion of a locking hinge;

a first elongate channel half spanning said first cavity portion and said first hinge portion; and a first collar portion of a child-proof capping assembly;

providing a second medicated product mold portion, said second product mold portion comprising:

a second cavity portion defined by a second recess in a second wall of said second medicated product mold portion;

a second hinge portion of said locking hinge;

a second elongate channel half spanning said second cavity portion and said second hinge portion; and a second collar portion of said child-proof capping assembly;

wherein said first cavity portion and said second cavity portion cooperatively define a lollipop head mold for receiving a medication, a medication delivery matrix, or a mixture of a medication and a medication delivery matrix; and wherein said first and said second elongate channel halves cooperatively form a channel for receiving a handle member that extends through said locking hinge into said first and said second cavity portions of the lollipop head mold portion.

15. The method of claim 14, further comprising bringing said first medicated product mold portion and said second medicated product mold portion into a confronting relationship and placing said medication, said medication delivery matrix, or said mixture of said medication and said medication delivery matrix within said medicated product mold.

16. The method of claim 15, further comprising providing a child-proof cap configured to reversibly engage said collar of said child-proof capping assembly; and engaging said cap with said collar.

17. The method of claim 15, wherein said locking hinge comprises an aperture for receiving said handle member therethrough.

18. The method of claim 17, further comprising advancing at least a portion of said handle member through said aperture of said locking hinge and into said medicated product mold.

19. The method of claim 14, wherein said first cavity portion is juxtaposed between said first hinge portion and said first collar portion.

* * * * *